US005406669A

United States Patent [19]

Lesiw

[11] Patent Number: 5,406,669

[45] Date of Patent: Apr. 18, 1995

[54] ROTARY BRUSH

[75] Inventor: Bill Lesiw, Cleveland, Ohio

[73] Assignee: The Milwaukee Brush Manufacturing Co., Inc., Milwaukee, Wis.

[21] Appl. No.: 148,207

[22] Filed: Nov. 5, 1993

[51] Int. Cl.[6] ..... A46B 13/02

[52] U.S. Cl. ..... 15/179; 15/23; 15/198; 15/206

[58] Field of Search ..... 15/23, 28, 179, 180, 15/181, 182, 183, 197, 198, 200, 205; 51/206 R, DIG. 17

[56] References Cited

U.S. PATENT DOCUMENTS

| | | | |
|---|---|---|---|
| 1,018,327 | 2/1912 | Krupp | 15/179 |
| 1,493,670 | 5/1924 | Galvin | 15/179 |
| 2,480,877 | 9/1949 | Peterson | 15/180 |
| 3,068,504 | 12/1962 | Peterson | 15/198 |
| 3,079,627 | 3/1963 | Albrecht | 15/23 |
| 3,314,095 | 4/1967 | Prange | 15/182 |
| 4,756,044 | 7/1988 | Clark | 15/182 |

OTHER PUBLICATIONS

The Milwaukee Brush Manufacturing Company Catalog 12a published in 1993 (entire publication).

*Primary Examiner*—David A. Scherbel
*Assistant Examiner*—Randall E. Chin
*Attorney, Agent, or Firm*—Godfrey & Kahn

[57] ABSTRACT

A rotary brush is disclosed for use in treating an object of interest. The rotary brush includes a central hub having a peripheral edge, and a plurality of apertures are formed in the hub and located in predetermined spaced relation along the peripheral edge; and a knot of wire is received in each of the apertures and defines a face having a variable width dimension.

5 Claims, 3 Drawing Sheets

ROTARY BRUSH

FIELD OF THE INVENTION

The present invention relates generally to a rotary brush and more specifically, to a rotary brush which has improved performance characteristics when compared with rotary brushes of conventional construction.

DESCRIPTION OF THE PRIOR ART

As should be understood, power brush finishing is a production method of metal finishing which employs wire; elastomer bonded wire; or non-metallic cord (which may include both natural fiber or synthetic fiber) which are incorporated into brushing wheels, and which are employed by automatic machines, semi-automatic machines and various portable power tools. These machines or implements are utilized to smooth or roughen, various objects of interest, or perform other tasks such as remove surface oxidation or weld scale, or remove various burrs which are a by-product of various manufacturing procedures.

Rotary brushes, as a general matter, include a plurality of individual wires which are referred to in the art as fill material. The ends of the individual wires are considered wire points. The wire points of a rotary brush are normally thought to act as individual cutting tools so that the rotary brush, in effect, acts as a multiple-tip cutting tool. In operation, the fill material contacts the surface of the work object and imparts an impact action which produces a coldworking effect. The type of finish produced depends upon the type of fill material utilized, the wheel speed, commonly expressed in RPM, and how the wheel is applied. Power brushes may also differ in other ways. For example, power brushes have different types of fill materials, such as, carbon steel, stainless steel, synthetic, tampico and other synthetic and manmade fibers. Additionally, the length of the fill material, and which is commonly referred to in the art as the trim may be selectively adjusted; and the density of the fill material can also be varied. It should be understood, that variations in the trim and density of the fill material, as well as the nature or type of the fill material utilized, and the speed of the power brush can be selectively combined to achieve various effects on the material which is being processed.

Power brushes have various configurations. For example, crimped tempered carbon steel or stainless steel wire brushes are available in a wide range of wire sizes from fine to coarse. In certain applications, crimped wire brushes having a brass wire fill are useful. As a general matter, crimped wire brushes having a wide face construction, and uniformly dense wire fill provide low flexibility, and fast cutting action. In other instances, wire brushes are manufactured which have knotted construction and which provide high impact action. These knotted brushes are typically used for such applications as weld cleaning; stringer bead weld cleaning; removal of heavy encrustations; scale removal; deburring; and various cleaning applications to name but a few. Depending upon the application, knotted brushing wheels can be supplied in either a standard twist; stringer bead twist; or full cable twist configuration. In a standard twist knot, the individual wires forming the knot are twisted about each other for only a portion of their individual lengths thereby providing a face which has a predetermined width dimension which is somewhat greater than the outside diameter of the twisted portion of the knot. For brushes which utilize a full cable twist, the knot of individual wires are twisted about each other for their entire length thereby providing a face having a predetermined width dimension which is substantially equal to the outside diametral dimension of the knot. These are shown in FIGS. 3 and 4, respectively. As a general matter, a stringer bead twist is similar to a full cable twist with the exception that the outside diameter of the stringer bead twist is narrower in relative comparison to the full cable twist.

While the prior art brushes, noted above, have operated with a fair degree of success, they have several shortcomings which have detracted from their usefulness. For example, and in the utilization of power brushes which have a knotted construction, standard twist knotted brushes have been employed, with success, for general applications, such as roughing surfaces for adhesion, cleaning, flash removal, and scale removal. While these brushes work well for these general, light duty applications, for tough cleaning, or for special applications, such as narrow width areas or bead weld cleaning, standard twist knotted brushes have been found inadequate, or less than desirable. Consequently, for these specific tough applications brushing operations have typically stopped, and a standard twist knotted wire brush is replaced with a full cable twist, or stringer bead twist wire brush. This replacement of a brush during a manufacturing process, is, of course, time consuming, and requires the use of various hand tools to accomplish the installation. Further, if the correct brush is not available, a worker may have to return at another point in time with the appropriate power tool, and brush, to complete the brushing operation.

Still a further shortcoming in the wire brush construction, noted above, relates to characteristics inherent in their individual designs. For example, in some brushing applications, due to the nature of the materials being treated, brushing occurs in two phases, that is, a first phase, which includes the use of a wire brush which has a standard twist knot, and which is employed to remove most of the heavy encrustation, scale or materials to be removed, such as paint or the like; and a second operation which requires the use of a wire brush which has a full cable twist,or stringer bead twist construction. As should be understood the time required to cover a predetermined surface area of material is directly related to the face width of the brush. As would be expected, and when utilizing a full cable twist which has a narrow face, the time it takes to cover a predetermined surface area is greater in relative comparison than the time it takes to cover the same surface area with a standard twist knotted brush which has a significantly wider face. Consequently, the time necessary to brush a predetermined object of interest may be quite long.

In view of the foregoing, it has long been known that it would be desirable to have a wire brush having a knotted type construction which may be utilized for various manufacturing operations and which further can be utilized for general brushing applications, but which further has a construction which allows it to be utilized for the toughest cleaning jobs, and which additionally has a low flex, and high impact cleaning action, and which further performs similar to a brush which has a full cable twist or stringer bead twist construction.

OBJECTS AND SUMMARY OF THE INVENTION

Therefore, it is an object of the present invention to provide an improved rotary brush.

Another object of the present invention is to provide a rotary brush which is operable to obtain the individual benefits to be derived from related prior art brushes, and manufacturing practices, while avoiding the detriments individually associated therewith.

Another object of the present invention is to provide a rotary brush which may be useful in general applications such as weld cleaning, stringer bead weld cleaning, weld spatter removal, removal of heavy encrustations, scale removal, deburring, and general cleaning and roughening of various surfaces for assorted manufacturing purposes.

Another object of the present invention is to provide a rotary brush which may be utilized in connection with various portable power tools, automatic machines or semi-automatic machines as manufacturing conditions warrant.

Another object of the present invention is to provide a rotary brush having a construction which includes both standard twist knots, and full cable twist knots in alternating positions.

Another object of the present invention is to provide a rotary brush which has a variable width face.

Another object of the present invention is to provide a rotary brush which is of relatively nominal cost to purchase and maintain, and which further is inexpensive to operate.

Another object of the present invention is to provide a rotary brush which is characterized by ease of employment, and simplicity of construction.

Further objects and advantages of the present invention are to provide improved elements and arrangements thereof in a rotary brush for the purposes described, and which is dependable, economical, durable, and fully effective in accomplishing its intended purposes.

These and other objects and advantages are achieved in a rotary brush for the purposes described, and which includes a central hub having a peripheral edge, and wherein a plurality of peripherally positioned apertures are formed in predetermined positions adjacent to the peripheral edge of the central hub; and a knot of wires are received through each of the peripherally positioned apertures, the individual knots of wire including both standard twist and full cable twist knots which are positioned in alternating relationship about the peripheral edge of the central hub.

DETAILED DESCRIPTION

Figure 1:
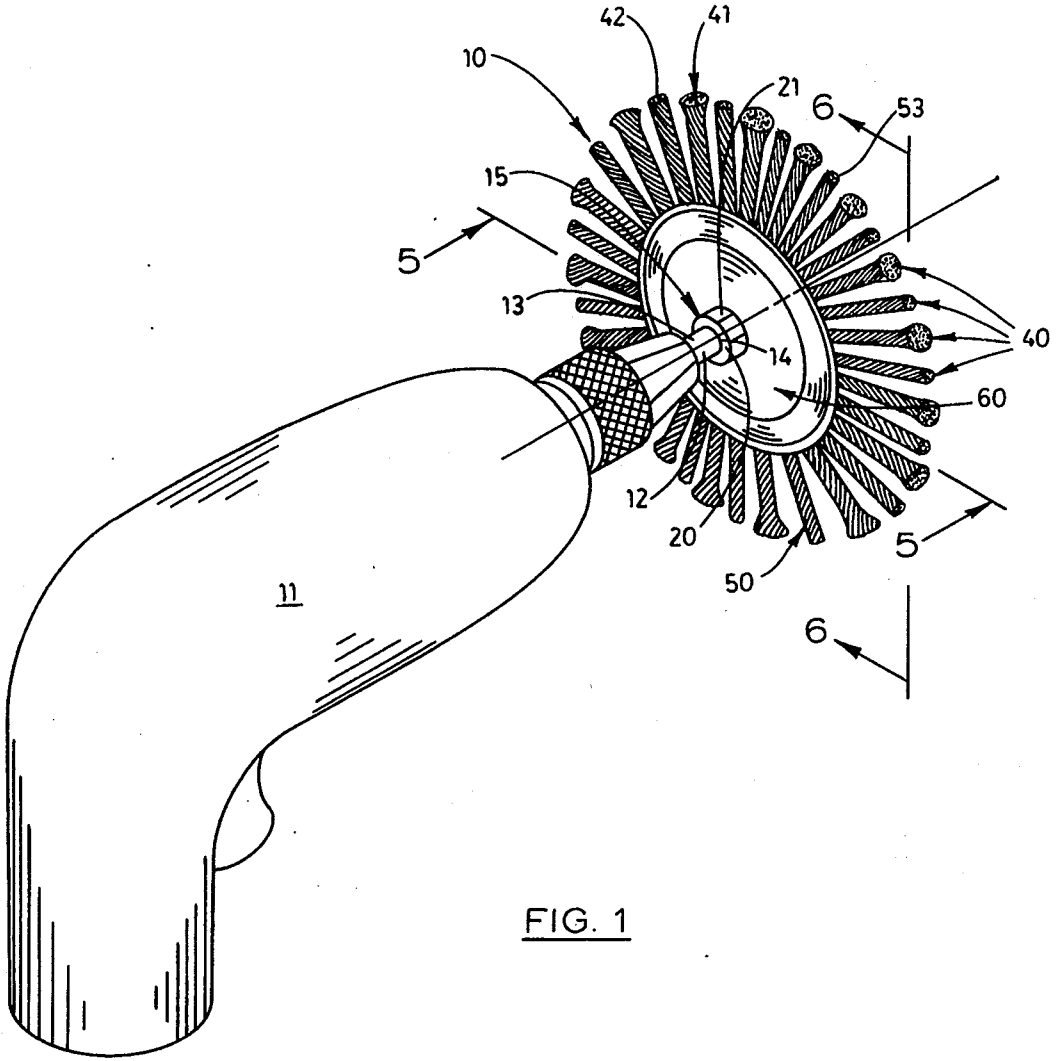
FIG. 1 is a perspective, environmental view of the rotary brush of the subject invention shown in a typical operative configuration where it is illustrated as mounted on a portable power tool of conventional design.

The rotary brush of the present invention is generally indicated by the numeral 10, and is best seen in the environmental view of FIG. 1. As should be understood, the apparatus 10 is rendered operable for use in combination with a portable power tool and which is generally indicated by the numeral 11. The portable power tool is of conventional design and may be energized by assorted power sources such as electricity, compressed air or the like. As best seen by reference to FIG. 1, the brush 10 is mounted on the power tool 11 by means of a rotatable shaft 12. The shaft has a first, or proximal end 13 which is rotatably mounted in driving relation relative to the power tool 11, and a second, opposite or distal end 14. Affixed to the second or distal end 14 is a shank mount 15 of conventional design. The shank mount secures the rotary brush 10 on the second or distal end 14. The shank mount has a main body 20 which defines a peripheral edge 21.

Figure 2:
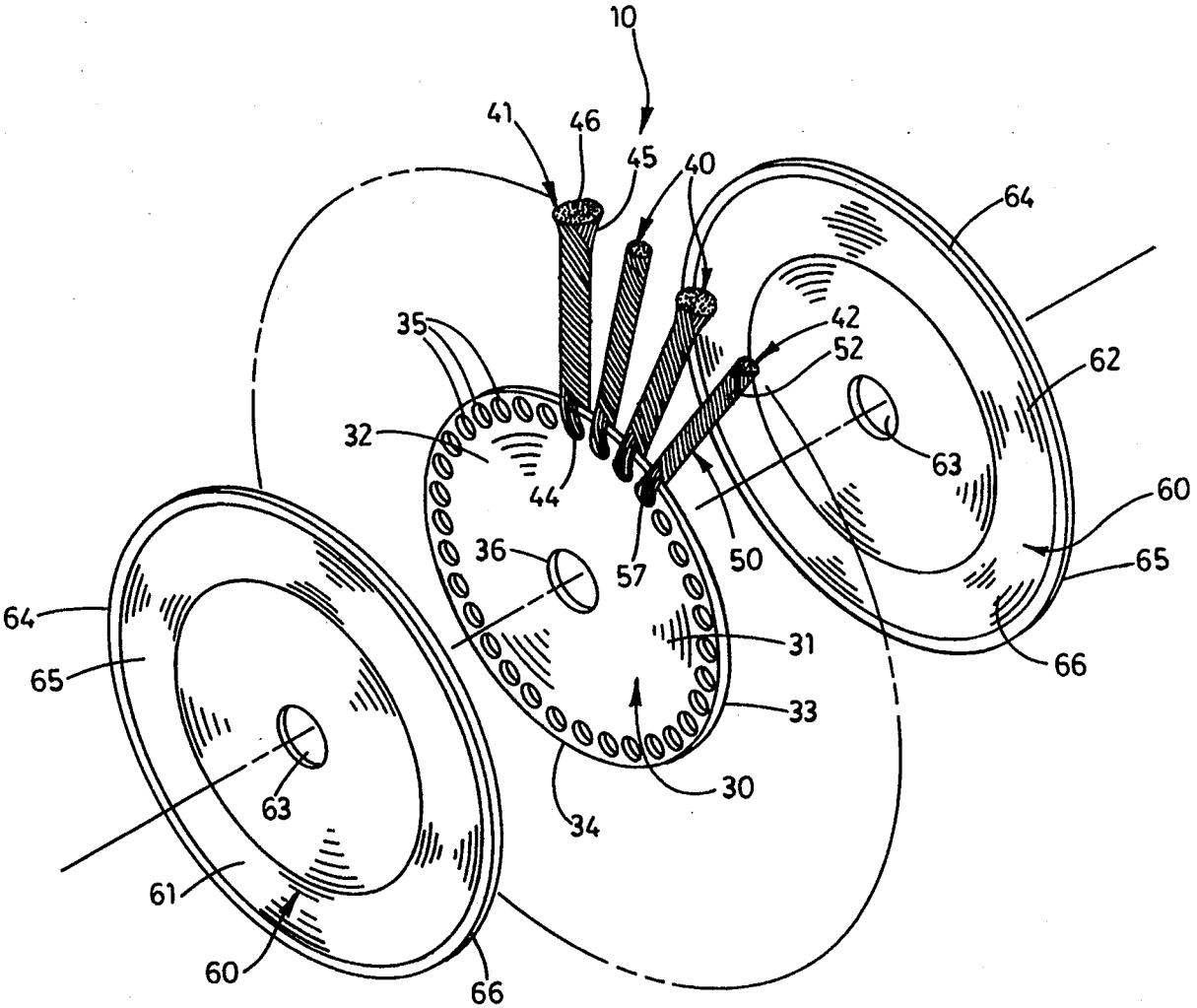
FIG. 2 is an exploded, perspective view of the rotary brush of the subject invention shown in a typical operative configuration.

The rotary brush 10 of the present invention includes a central hub, or portion which is best seen by reference to the perspective, exploded view of FIG. 2. The central hub or portion 30, has a main body 31 which has a substantially circular shape, and which has a top, or first surface 32, and an opposite, bottom or second surface 33. The main body 31 further defines a peripheral edge 34. Formed in close proximity to the peripheral edge are a plurality of individual apertures or knot holes 35 which have predetermined diametral dimensions. The apertures or knot holes are operable to receive individual wire knots which will be discussed in greater detail, hereinafter. Further, an axially oriented and centrally disposed arbor hole 36 is formed in the main body 31, and has a predetermined diametral dimension which is just slightly greater than the outside diametral dimension of the main body 20, of the shank mount 15. It should be understood that the shank mount is operable to be received in the arbor hole and the rotary brush 10 is secured on the shank mount by conventional fasteners, not shown.

Figure 4:
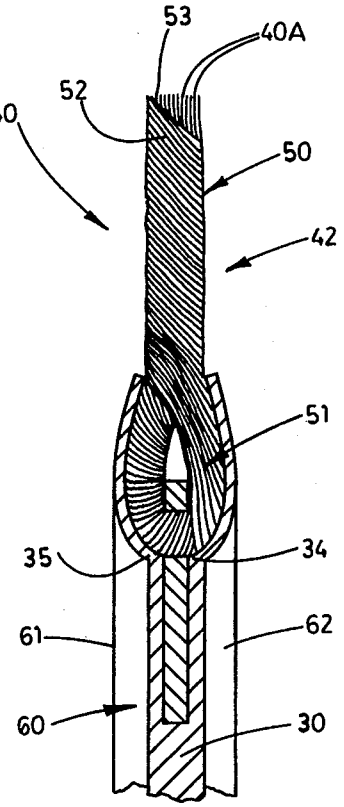
FIG. 4 is a fragmentary, side elevation view of a full cable twist knot.
Figure 3:
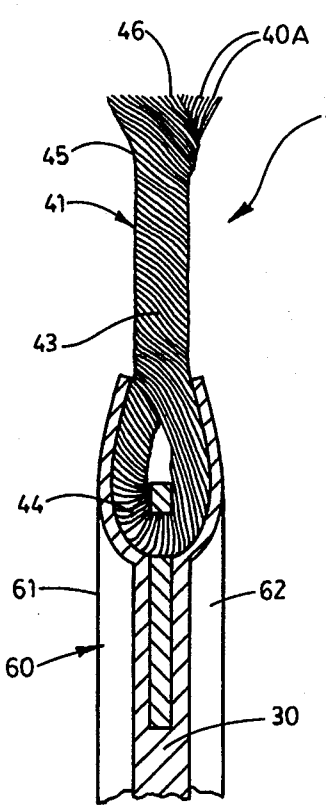
FIG. 3 is a fragmentary, side elevation view of a standard twist knot.
Figure 6:
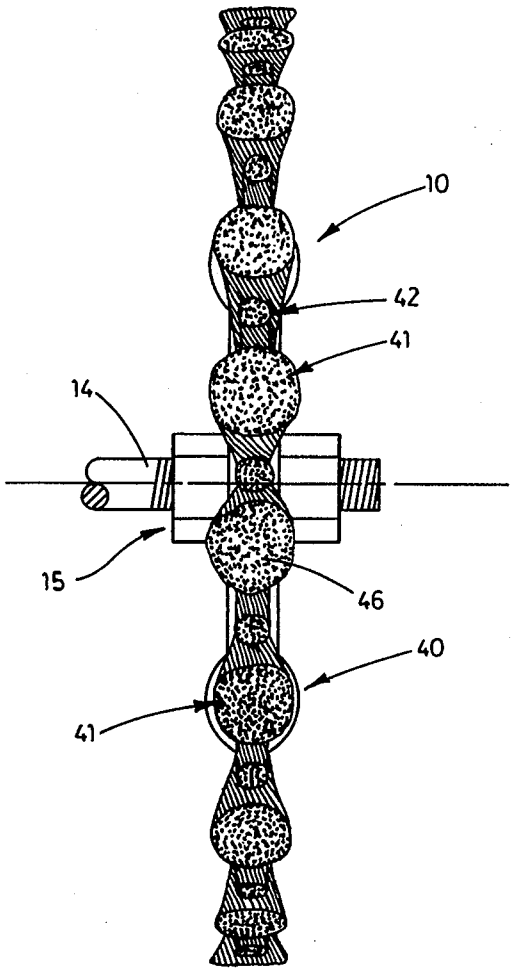
FIG. 6 is a fragmentary, face view of the rotary brush of the present invention, and which is taken from a position along line 6—6 of FIG. 1.
Figure 5:
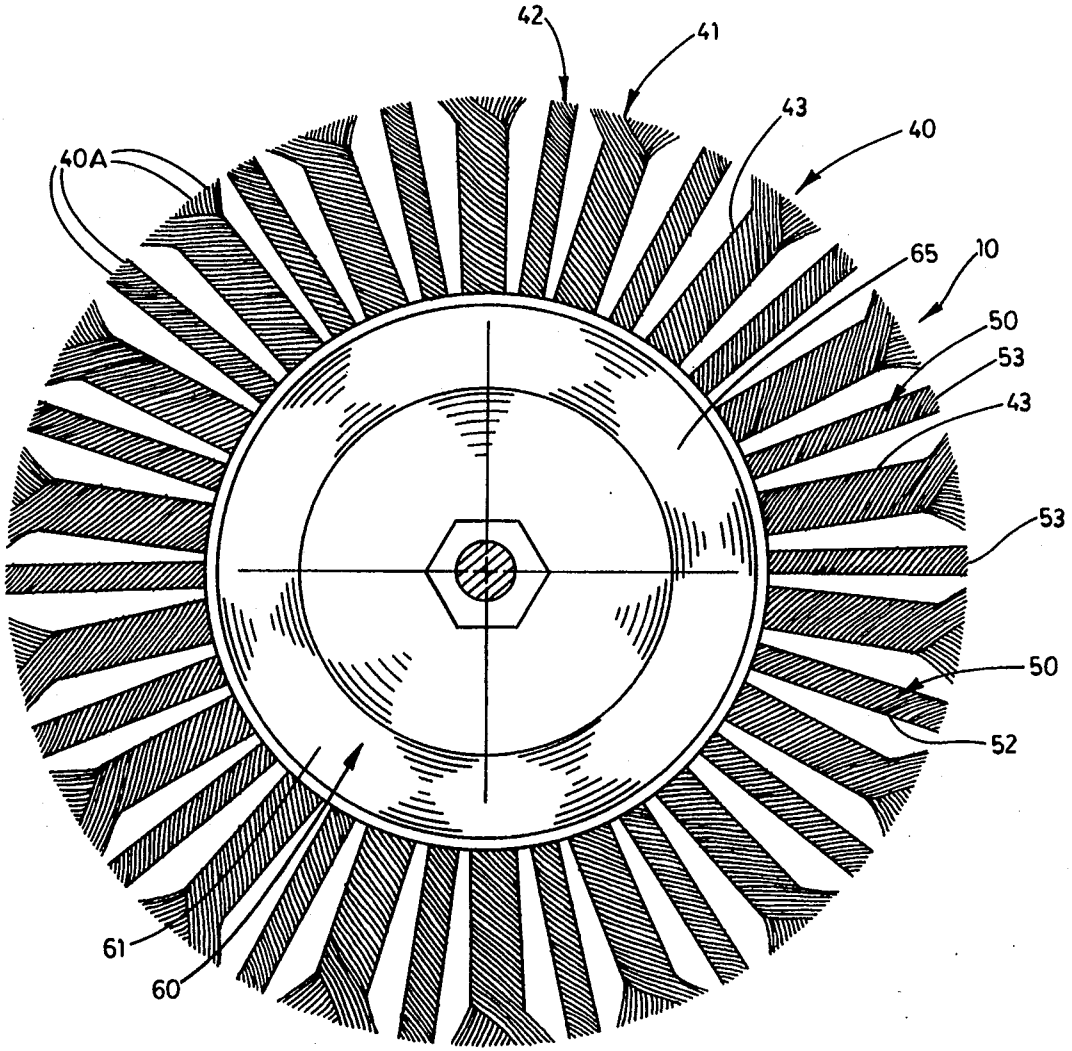
FIG. 5 is a fragmentary, side elevation view of the rotary brush of the subject invention and which is taken from a position along line 5—5 of FIG. 1.

As best seen by reference to FIG. 2, the rotary brush 10 of the present invention includes a plurality of wire knots which are generally indicated by the numeral 40. Each of the individual knots of wires 40 include a plurality of individual wires 40A which are twisted about each other and which may be manufactured from high carbon tempered steel or stainless steel. The individual knots of wires 40 are of substantially the same trim or length. The plurality of wire knots 40 include individual standard twist knots 41, and individual full cable twist knots 42, which are positioned in alternating positions about the peripheral edge 34 of the central hub or portion of 30. As best seen by reference to FIG. 3, the standard twist knots 41 each have a main body 43 which includes a proximal end 44, which is received through the individual knot holes 35, and a distal end 45, which defines a knot face 46, and which is operable to engage an object of interest, not shown. As should be understood from a study of FIG. 1, standard twist knots have a main body 43 which includes a plurality of wires 40A which are twisted about each other for only a portion of their length. As best seen in FIG. 3, the extreme distal ends 45 of the individual wires 40A are spaced a predetermined distance apart thereby defining the knot face 46 which has a predetermined width dimension. Similarly, the individual full cable twist knots 42 (FIG. 4) have a main body 50 which includes a first or proximal end 51, which is received through the individual knot holes 35, and a second, remote, or distal end 52, which is operable to engage an object of interest, not shown. The second, remote or distal end 52 defines a knot face 53, which has a predetermined width dimension which is less than the face dimension of the individual standard twist knots 41. As should be evident, this face dimension of the full cable twist knot is less because the individual wires 40A, which comprise the main body 50, are twisted about each other for their entire length, as compared with the individual standard twist knots which are twisted about each other for only a portion of their length. The individual knot faces 46 and 53 are positioned in alternating relationship such that each knot face is oriented immediately adjacent to another knot face having a different width dimension. As best seen by reference to FIG. 6, the face of the rotary brush 10, therefore, has a variable or undulating width face dimension. As should be understood, prior art brushes, heretofore, have utilized wire knots as described above, but the brushes have been either, uniformly standard twist knots, or in the alternative uniformly full cable twist knots. As earlier discussed, for general applications a brush having standard twist knots is appropriate. However, for the toughest applications, full cable twist knots are utilized. In this regard, the full cable twist knot brushes provide low flex and high impact cleaning action and narrow face widths as opposed to the standard twist knot brushes which have a wider face and lower impact cleaning action.

Cover plates which are generally indicated by the numeral 60 are fastened on the central hub, or portion 30 by utilizing conventional fastening techniques such as spot welding or the like. The cover plates include a first cover plate 61, and an opposite, or second cover plate 62. The individual cover plates 61 and 62 have substantially axially oriented, and centrally disposed arbor holes 63 which have a diametral dimension which is approximately equal to the diametral dimension of the arbor hole 36 which is formed in the main body 31, of the central hub or portion 30. Further, the individual cover plates have a peripheral edge 64, a top or exterior facing surface 65, and a bottom or interior facing surface 66.

OPERATION

The operation of the preferred embodiment of the present invention is believed to be readily apparent and is briefly summarized at this point. The rotary brush of the present invention is generally indicated by the numeral 10 in FIG. 1. The rotary brush 10 includes a central hub, or portion 30 which has a peripheral edge 34. A plurality of peripherally positioned knot holes or apertures 35 are formed in the central hub and located in close proximity to the peripheral edge. Individual wire knots 40 are received through each of the peripherally positioned apertures. The individual knots of wire include both standard twist knots 41, and full table twist knots 42. The individual standard and full cable twist knots are positioned in alternating relationship about the peripheral edge of the central hub thereby providing a rotary brush that has a variable width face dimension. This is best seen by reference to FIG. 6. The rotary brush 10 of the present invention also provides an arbor hole 36 which facilitates the fixing of the brush on a shank mount 15 which is rotated by a power tool 11, of conventional design.

Therefore, the rotary brush 10 of the present invention can be employed in a wide variety of commercial environments and further, can be utilized to address manufacturing situations where several conventional wire brushes, of different designs, have been utilized heretofore. The rotary brush of the present invention is easily mounted on power tools of conventional design, is simple to maintain, and further can be manufactured at a nominal price when compared with other prior art devices which are utilized for substantially similar purposes.

While the present invention has been herein shown and described in what is conceived to be the most practical and preferred embodiment, it is to be recognized that departures may be made therefrom within the scope of the invention which is not to be limited to the illustrative details disclosed.

Having described my new invention what I claim is new and desire to secure by Letters Patent of the United States is:

1. A rotary brush comprising:

a central hub having a peripheral edge, and wherein a plurality of apertures are formed in predetermined positions adjacent to the peripheral edge of the central hub; and a plurality of knots of wires, each knot of wire individually received through each of the peripherally positioned apertures, and wherein the individual knots of wires include a plurality of individual wires which are twisted about each other, the knots of wires including both standard twist, and full cable twist knots which are positioned in alternating relationship about the peripheral edge of the central hub, and wherein each knot of wire has a proximal end which is positioned adjacent to the central hub and a distal end which defines a knot face, and wherein the knot face of the individual standard twist knots have a given width dimension, and the knot face of the individual full cable twist knots have a width dimension which is less than the width dimension of the standard twist knots, and wherein the individual knot faces form a brush face having a variable width dimension.

2. A rotary brush as claimed in claim 1, and wherein the individual knots of wire have substantially the same length.

3. A rotary brush comprising:

a central hub having a peripheral edge, and wherein a plurality of apertures are formed in the hub and located in predetermined spaced relation along the peripheral edge; and a plurality of knots of wires, each knot of wire individually received in each of the apertures and wherein the individual knots include a plurality of individual wires which are twisted about each other, and wherein each knot of wire has a distal end defining a knot face which has a predetermined width dimension, and wherein the individual knot faces are oriented in alternating relationship such that each knot face is positioned immediately adjacent to another knot face which has a different width dimension thereby forming a brush face having an undulating width face dimension.

4. A rotary brush as claimed in claim 3, and wherein the individual knots of wire include standard twist and full cable twist knots in alternating positions about the peripheral edge of the central hub.

5. A rotary brush comprising:

a central hub having a peripheral edge and a plurality of apertures formed in predetermined positions adjacent to the peripheral edge of the central hub; and a plurality of knots of wire, each knot of wire individually received through each of the peripherally positioned apertures and wherein the individual knots include a plurality of individual wires which are twisted about each other, and wherein the knots of wires include both standard twist and full cable twist knots which are positioned in alternating relationship about the peripheral edge of the central hub, and wherein the individual knots of wires are of substantially identical length and form a brush face having an undulating width face dimension.

* * * * *